United States Patent [19]

Robertson et al.

[11] 4,269,632

[45] May 26, 1981

[54] FABRICATION OF ALUMINUM ALLOY SHEET FROM SCRAP ALUMINUM FOR CONTAINER COMPONENTS

[75] Inventors: King G. Robertson; Donald C. McAuliffe, both of Golden, Colo.

[73] Assignee: Coors Container Company, Golden, Colo.

[21] Appl. No.: 931,040

[22] Filed: Aug. 4, 1978

[51] Int. Cl.[3] ..... C22F 1/04

[52] U.S. Cl. ..... 148/2; 148/11.5 A; 148/12.7 A; 148/32; 148/32.5

[58] Field of Search ..... 148/2, 11.5 A, 12.7 A, 148/32, 32.5

[56] References Cited

U.S. PATENT DOCUMENTS

| | | | |
|---|---|---|---|
| 3,502,448 | 3/1970 | Anderson et al. | 148/11.5 A |
| 3,787,248 | 1/1974 | Setzer et al. | 148/11.5 A |
| 3,802,931 | 4/1974 | Bylund | 148/11.5 A |
| 3,814,590 | 6/1974 | Bylund | 29/527.7 |

*Primary Examiner*—R. Dean

*Attorney, Agent, or Firm*—Bruce G. Klaas; Richard D. Law; Dennis K. Shelton

[57] ABSTRACT

A composition and method whereby aluminum scrap, including consumer scrap, is recycled and fabricated into aluminum sheet and aluminum containers. Aluminum scrap is melted in a heated furnace to form a melt composition. The melt is adjusted to form the present composition, consisting essentially of silicon, 0.1–1.0%; iron 0.1–0.9%; manganese 0.4–1.0%; magnesium 1.3–2.5%; copper 0.05–0.4%; and titanium, 0–0.2%, the balance being essentially aluminum. Aluminum scrap comprising consumer scrap, plant scrap, and can making scrap is heated to form the melt composition, which requires a minimum amount of adjustment to arrive at the present alloy composition. The composition is then cast and fabricated into sheet having strength and formability properties making it suitable for container manufacture. Container manufacture according to the process and composition of the present invention comprises drawn-and-ironed can body manufacture and easy-opening end manufacture. Sheet fabrication according to the present invention comprises direct chill casting, scalping, preheating, hot breakdown rolling, continuous hot rolling, annealing, cold rolling and shearing.

14 Claims, 3 Drawing Figures

FABRICATION OF ALUMINUM ALLOY SHEET FROM SCRAP ALUMINUM FOR CONTAINER COMPONENTS

CROSS REFERENCE TO RELATED APPLICATIONS

Reference should be had to "An aluminum composition for the manufacture of container components from scrap aluminum" by King Robertson Ser. No. 931,036, "Method of recycling aluminum scrap into sheet material for aluminum containers" by King Robertson and Donald McAuliffe Ser. No. 931,041, and "Continuous strip casting of aluminum alloy from scrap aluminum for container components" by Ivan Gyoengyoes, Heinz Bichsel, and Kurt Buxmann Ser. No. 931,039, filed concurrently herewith.

BACKGROUND OF INVENTION

In general, the present invention relates to aluminum sheet metal materials for metallic containers and components thereof, and methods and processes of manufacture thereof enabling and facilitating the manufacture of containers and the like by use of materials of used empty containers and scrap materials as part of a recycling system.

At the present time, substantial efforts are being made to conserve energy and material resources as well as to eliminate waste and litter problems which have long plagued the beverage industry in particular. The present invention is part of an attempt to develop a total recycle program in the aluminum can industry including: (1) the collection and return of aluminum beverage cans after use by the consumer; and (2) the re-use of the aluminum material of used cans to manufacture new cans.

Thus, the primary purpose of the present invention is to provide an economically feasible recycle program for aluminum beverage cans. The primary purpose has been fulfilled by development of a new aluminum alloy composition enabling the manufacture of all components of aluminum cans from a single alloy composition by new methods and processes which provide single alloy composition sheet stock suitable for use with conventional aluminum can making equipment, methods and processes. As a result of the use of the new composition and the new methods and processes, an aluminum can having all components made from sheet stock of the same alloy composition may be produced by high speed mass production techniques whereas, in the past, different components of commercially acceptable aluminum cans have been made from different alloy compositions such as shown in the following Table I:

refer to the registration of the alloy with the Aluminum Association. CS42 refers to an Alcoa alloy developed for use in can ends and tabs and further described below.

Aluminum food and beverage containers have been successfully manufactured since the early 1960's. As used herein, the term "container" refers to any aluminum sheet product formed to contain a product, including carbonated beverage cans, vacuum cans, trays, dishes, and container components such as fully removable ends and ring tab ends. The term "can" refers to a fully enclosed container designed to withstand internal and external pressure, such as vacuum and beverage cans. Initially only can ends were formed of aluminum and were termed "soft tops". These tops had no easy opening features and were manufactured from Aluminum Association (AA alloy) 5086. The introduction of easy opening ends such as the "ring pull" end required the use of more formable alloys such as AA 5182, 5082 and 5052. The commonly used 5082 and 5182 are high in magnesium content (4.0–5.0%) and are designed to be relatively strong as compared to those alloys used in can bodies. 5052 is primarily used in shallow drawn and drawn and redrawn non-pressurized containers, as it lacks sufficient strength for most can applications.

Shortly after the introduction of aluminum can ends, aluminum can bodies were introduced. Aluminum can bodies were initially made as parts of three piece cans, as "tin" cans had traditionally been made. Three piece cans consist of two ends and a body which is formed into a cylindrical shape and seamed. Two piece cans have since been developed and are gradually replacing three piece cans in beverage applications. Two piece cans consist of a top end and a seamless body with an integral bottom end. Two piece can bodies are formed by a number of processes, including shallow drawing, drawing and redrawing, and drawing-and-ironing.

An apparatus for making drawn-and-ironed cans is described in U.S. Pat. No. 3,402,591, to which attention is directed for a further understanding of the can body manufacturing aspect of the present invention. In drawing and ironing, the body is made from a circular sheet, or blank, which is first drawn into a cup. The side walls are then extended and thinned by passing the cup through a series of dies with diminishing bores. The dies produce an ironing effect which lengthens the side walls and permits the manufacture of can bodies having sidewalls thinner than their bottoms. AA 3004 is typically used in the formation of two piece can bodies, as it provides adequate formability, strength, and tool wear characteristics for the draw-and-iron process. These properties are a function of the low Mg (0.8–1.3%) and Mn (1.0–1.5%) content of the alloy.

TABLE I

| Alloy | Silicon | Iron | Copper | Manganese | Magnesium | Chromium | Zinc | Titanium | Others Each | Others Total |
|---|---|---|---|---|---|---|---|---|---|---|
| AA 3003 | 0.6 | 0.7 | 0.05–0.2 | 1.0–1.5 | — | — | 0.10 | — | 0.05 | 0.15 |
| AA 3004 | 0.30 | 0.70 | 0.25 | 1.0–1.5 | 0.8–1.3 | — | 0.25 | — | 0.05 | 0.15 |
| AA 5182 | 0.20 | 0.35 | 0.15 | 0.20–0.50 | 4.0–5.0 | 0.10 | 0.25 | 0.10 | 0.05 | 0.15 |
| AA 5082 | 0.02 | 0.35 | 0.15 | 0.15 | 4.0–5.0 | 0.15 | 0.25 | 0.10 | 0.05 | 0.15 |
| AA 5052 | 0.45 | Si + Fe | 0.10 | 0.10 | 2.2–2.8 | 0.15–0.35 | 0.10 | — | 0.05 | 0.15 |
| CS42 | 0.20 | 0.35 | 0.15 | 0.20–0.50 | 3.0–4.0 | 0.10 | 0.25 | 0.10 | 0.05 | 0.15 |

The numerical amounts shown represent weight percentages. The ranges shown are inclusive. These conventions are carried throughout the present specification. All percentages shown above are maximums unless a range is shown. The AA designation and number The presently used 3004 is disadvantageous in that it requires a high ingot preheat or homogenization temperature for a long time in order to achieve the desired final properties. Conventional ingot preheating is one of the most costly factors in producing finished sheet. In addition, 3004 has a relatively slow casting rate and a tendency to form large primary segragation when improperly cast.

Other alloys have been previously considered for use in can bodies, such as AA 3003. This alloy meets all forming requirements for the draw-and-iron process, but was abandoned because of low strength at economical gauges.

The conventional alloys described above for can ends and can bodies differ significantly in composition. In the manufactured can, the end and the body are essentially inseparable so that an economical recycle system requires use of the entire can. Therefore, in recycling cans, the melt composition differs significantly from the compositions of both conventional can end alloys and conventional can body alloys. It it is desired to obtain the original compositions, significant amounts of primary, or pure, aluminum must be added to obtain a conventional can body alloy composition, and even greater amounts of primary aluminum must be added to obtain a conventional can end alloy composition.

Accordingly, it would be advantageous to employ an aluminum alloy of the same composition in both can ends and can bodies so that the remelt from those cans would not have to be adjusted. This advantage was recognized and described by Setzer et al. in U.S. Pat. No. 3,787,248, which proposes a can end and body which are both made from a 3004 type alloy which has been heat treated to provide the formability necessary for its use in can ends. The fabrication process proposed by Setzer et al., however, includes a high temperature holding step after cold rolling. Furthermore, the compositions proposed by Setzer et al. would produce a melt composition significantly different from a melt of conventional two alloy cans.

SUMMARY OF THE INVENTION

The present invention provides sheet fabrication processes whereby recycled scrap may be economically converted to single alloy sheet materials for forming all container components. By melting of all aluminum scrap, including used and defective cans, can making scrap and plant scrap, an initial melt composition is formed which then may be readily adjusted to form a single alloy composition consisting essentially of silicon, 0.1–1.0%; iron 0.1–0.9%; manganese 0.4–1.0%; magnesium 1.3–2.5%; chromium 0–0.1%; zinc 0–0.25%, copper 0.05–0.4% and titanium, 0–0.2%, the balance being essentially aluminum. The composition requires a minimum addition of pure aluminum to the initial melt composition due to the quantitative and qualitative makeup of the present alloy composition. The present composition is cast and fabricated into single alloy sheets having strength and formability properties making it suitable for container body, end, and easy open device manufacture by conventional equipment and processes. In general, the methods and processes of the present invention comprise: (1) melting of scrap in a heated furnace to form an adjusted melt composition of the present invention; (2) casting of the present composition into an ingot; (3) preheating the ingot; (4) hot rolling the ingot to a strip form; and (5) variously cold rolling the strip material with necessary interanneals to at least 40% reduction for sheet forms of suitable thickness and characteristics for the manufacture of the various can components.

The use of the present alloy composition provides several advantages in the manufacture of the sheet materials and in the manufacture of the can components from those sheet materials, including:

(1) improved castability and ingot treatment as compared to conventional can body alloys, including the reduction of preheat and scalping requirements;

(2) lower energy requirements in hot and cold rolling operations and improved thermal response as compared to conventional can end alloys;

(3) improved material handling requirements in a rolling mill due to a number of fabrication steps which are identical for can end stock and can body stock;

(4) reduced separation of alloys for inventory and handling, including alloy makeup and casting procedures resulting from fabricating can end stock and can body stock from a single composition; and (5) the subsequent manufacture of all components of the can from sheet materials having a single alloy composition.

DESCRIPTION OF THE PREFERRED EMBODIMENT

Figure 1:
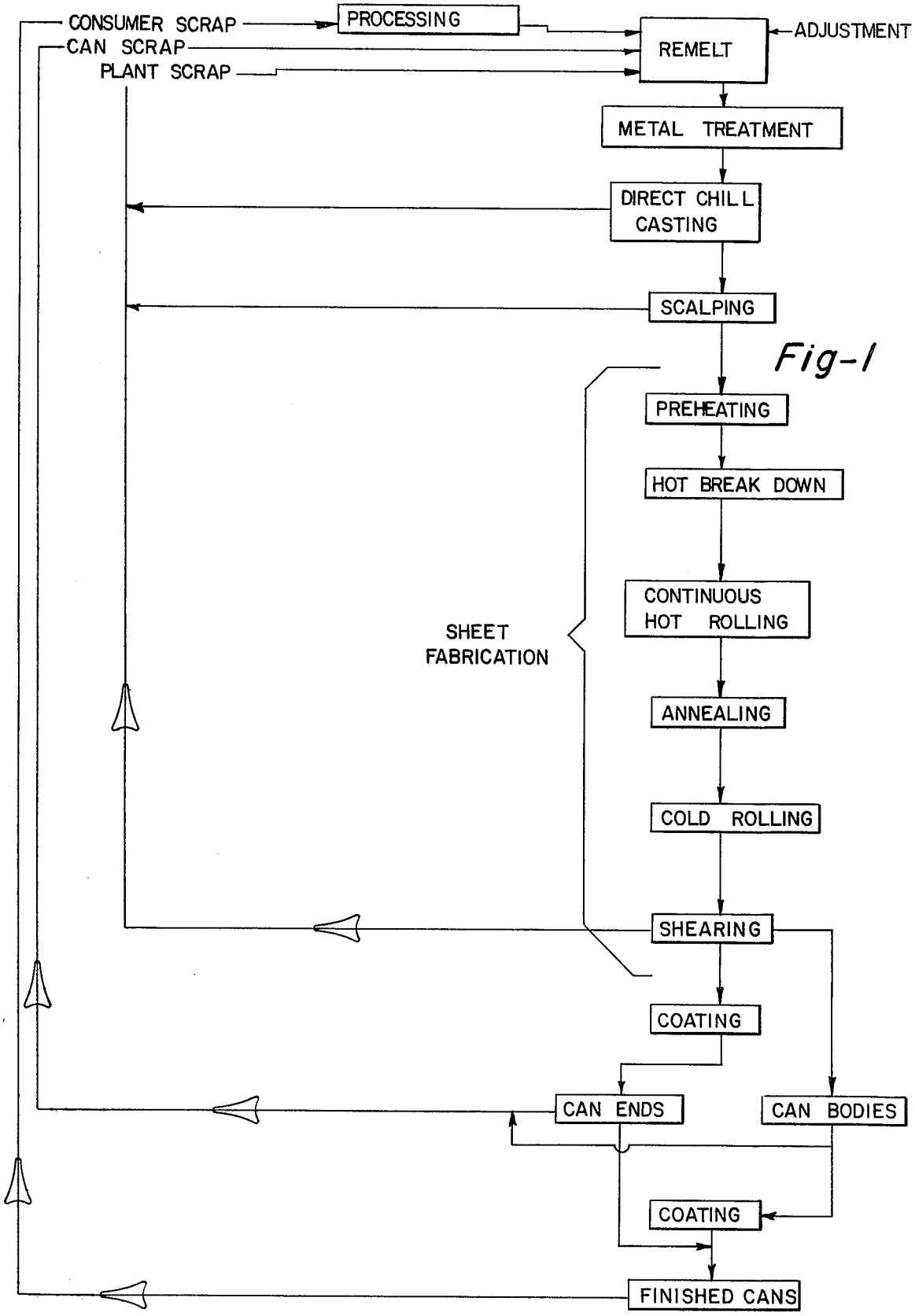
FIG. 1 is a flow chart of the processes of an embodiment of the present invention utilizing direct chill casting.

Referring now to FIG. 1, the processes of melting various types of scrap, adjusting the melt to a desired composition, casting the melt, fabricating alloy sheet, and manufacturing container products from the sheet may be seen to comprise a closed loop system wherein scrap generated by the manufacturing process is recycled to provide raw material for the process. The scrap used in the present invention comprises plant scrap, can scrap and consumer scrap.

PROCESSING CONSUMER SCRAP

Consumer scrap refers to aluminum alloy products, especially cans, which have been decorated, coated, or otherwise contaminated, sold, and used.

The process of the present invention is particularly adapted for use with scrap aluminum cans. In the preferred practice, cans are recovered in their cleanest form, free from dirt, plastic, glass, and other foreign contamination. The can bodies of conventional aluminum cans are inseparable from the can ends. Therefore during recovery of scrap cans, the whole cans are crushed, flattened, baled, or otherwise compacted. The cans are then reduced to shreds by a conventional grinder, hammer mill, contra-rotating knives, etc., to reduce the cans to small particles, preferably into a loose, open form of approximately 2.5–4.0 cm nominal diameter. The shredded aluminum scrap is subjected to magnetic separation to remove iron and steel contaminants, and to gravity or cyclone separation to remove paper and lightweight contaminants. The cleaned scrap is then introduced into a delacquering furnace. A suitable delacquering furnace is a rotary kiln, wherein scrap is transported, with hot air, through a rotating tunnel. Alternatively, a delacquering furnace may be employed which contains a stainless steel belt which holds a bed approximately 15–25 cm deep of shredded scrap.

Heated air is blown through the belt and scrap to burn organics such as plastic coatings used on the surfaces of food and beverage containers, as well as painted or printed labels containing pigments such as titanium (IV) oxide.

The preferred temperature of the furnace is such as to raise the temperature of the scrap to a pyrolysis temperature, typically 480°-580° C., sufficient to pyrolyze any organic coating materials but not to oxidize the metal scrap.

SCRAP MELTING

A. Scrap Input

The scrap used in the present invention comprises aluminum alloy material such as plant scrap, can scrap and consumer scrap processed as described above. A large portion of consumer scrap consists of aluminum cans, which typically contain 25% by weight AA 5182 can ends and 75% by weight AA 3004 can bodies. The compositions of these alloys and the composition obtained from remelting can scrap of these alloys are further described in Table II hereinbelow.

Plant scrap comprises ingot scalpings, rolled strip slicings, and other alloy trim produced in a rolling mill operation. The initial melt composition obtained from a typical plant scrap based on 88% 3004 and 12% CS 42, which is another high magnesium alloy used in producing can ends, is further described in Table III hereinbelow.

The scrap used in the present invention may also include can scrap from the manufacture of containers and container components such as can ends and can bodies. Can scrap includes scrap produced by earing and galling during can manufacture. The scrap used in the present invention may also include other aluminum material rich in alloy hardeners, and is also intended to include consumer, plant, and can scrap produced from the alloy of the present invention.

B. Alloy Preparation

The scrap to be recycled is charged into a furnace as is known in the art and described, for example, in U.S. Pat. No. 969,253. The scrap is melted in a furnace to form a melt composition. The initial melt will vary in composition according to the compositions and amounts of the various types of scrap charged in the furnace. In the process of the present invention, the initial melt is adjusted to bring the composition within the following ranges:

| | Broad Range: | Preferred Range: |
|---|---|---|
| Magnesium | 1.3-2.5 | 1.6-2.0 |
| Manganese | 0.4-1.0 | 0.6-0.8 |
| Iron | 0.1-0.9 | 0.3-0.7 |
| Silicon | 0.1-1.0 | .15-.40 |
| Copper | .05-0.4 | 0.3-0.4 |
| Titanium | 0-0.2 | 0-0.15 |

The above stated values represent the broad and preferred composition ranges of the alloy used in the present process. The composition of the present alloy may vary within the ranges stated but the ranges themselves are critical, especially those of the primary alloying elements magnesium and manganese. Magnesium and manganese together exhibit a solid solution strengthening effect in the present alloy. Therefore, it is essential to provide these elements in amounts within the stated ranges as well as in a ratio of mangesium to manganese of between 1.4:1 and 4.4:1, and in a total concentration of magnesium and manganese of 2.0-3.3%. Other trace elements in the form of impurities may be expected from recycling and are tolerable in the present composition up to certain limits. These impurities include chromium up to 0.1%, zinc up to 0.25%, and others up to 0.05% each, and up to 0.2% total.

Copper and iron are included in the present composition due to their inevitable presence in consumer scrap. The presence of copper between 0.05 and 0.2% also enhances the low earing properties and adds to the strength of the present alloy.

In order to arrive within the stated ranges or at the preferred composition of the present alloy, it may be necessary to adjust the melt. This may be carried out by adding magnesium or manganese, or by adding unalloyed aluminum to the melt composition to dilute the excess alloying elements. The total energy needed to produce unalloyed primary aluminum from its ore in refining and smelting is approximately twenty times the energy required for melting scrap aluminum. Considerable energy and cost can therefore be saved by minimizing the amount of primary aluminum needed to produce a desired alloy. If excess magnesium is present, the amount of magnesium in the melt may also be reduced by fluxing the molten alloy with chlorine gas to form insoluble magnesium chloride which is removed with the dross. This process, however, is not desirable due to the loss of magnesium from the alloy, and because of the environmental and occupational hazards associated with chlorine gas. Adjusting of the melt may also be carried out by the addition of lower alloy aluminum using the appropriate ratios to dilute excess elements.

Table II below shows the compositions of AA 3004, 5182 and the stoichiometric melt composition obtained from melting typical consumer scrap composed of cans made from these alloys:

TABLE II

| ALLOY (TYPICAL COMPOSITION) | | | | PRIME FACTOR (%) | | |
|---|---|---|---|---|---|---|
| ALLOY ELEMENTAL | 3004 | 5182 | MELT | TO 3004 | TO 5182 | TO NOMINAL |
| Magnesium | 0.9 | 4.5 | 1.5 | 40 | — | — |
| Manganese | 1.0 | 0.25 | .8 | — | 70 | 18 |
| Iron | 0.45 | 0.25 | .4 | — | 39 | 3 |
| Silicon | 0.2 | 0.12 | .2 | — | 33 | — |
| Titanium | 0.04 | 0.05 | .04 | — | — | — |
| Copper | .18 | 0.08 | .1 | — | 27 | — |

The figure of 1.5% magnesium in the column headed "MELT" is based on an assumed 0.3% loss in the remelt due to magnesium oxidation in the melting process.

The portion of the table headed "Prime Factor" shows the percentage amounts of primary, or pure, aluminum which must be added to the melt to bring each element of the melt to the nominal composition of 3004, 5182, or the present alloy. The nominal composition of the present alloy, as used in the specification and examples, has the following composition: magnesium, 1.8%; manganese, 0.7%; iron, 0.45%; silicon, 0.25%; copper, 0.2%; and titanium, 0.05%. Since the stated amounts of alloying elements in 3004 and 5182 other than magnesium or manganese are maximums, the largest prime factor shown for each alloy is controlling.

Thus, Table II shows that an amount of pure aluminum equal to 40% of the weight of the can scrap melt composition must be added if one were to reduce the amount of magnesium in the melt to the 0.9% typical magnesium content of 3004. Similarly, an amount of pure aluminum equal to 70% of the melt weight must be added if one were to reduce the amount of manganese in the melt to the typical 0.25% 5182 content. On the other hand, only 18% pure aluminum is necessary to bring the melt to the nominal manganese content of the present alloy.

Table III illustrates the same point with regard to plant scrap comprising 88% 3004 and 12% CS42:

TABLE III

| | TYPICAL COMPOSITION % | | | PRIME FACTOR % | | |
|---|---|---|---|---|---|---|
| | 3004 | CS42 | MELT | TO 3004 | TO CS42 | TO NOMINAL |
| Magnesium | 0.9 | 3.5 | 1.21 | 26 | — | — |
| Manganese | 1.0 | .25 | .91 | — | 73 | 23 |
| Iron | 0.45 | .25 | .43 | — | 42 | 5 |
| Silicon | 0.2 | .12 | .19 | — | 37 | — |
| Titanium | .04 | .05 | .04 | — | — | — |
| Copper | .18 | .08 | .17 | — | 53 | — |

26% Prime aluminum would be necessary to bring the above melt to a 0.9% magnesium 3004 composition, and 73% prime aluminum would be necessary to bring the melt to a 0.25% manganese CS42 composition, while only 23% prime aluminum would be necessary to bring the melt to the nominal manganese content of the present alloy.

Tables II and III demonstrate that the composition and method of the present invention permit an adjustment of less than 25% unalloyed aluminum, which is less than the adjustment required to arrive at any of the known container alloys. The Tables also demonstrate that the type of scrap in the melt will affect the amount of prime metal needed to bring the melt to a desirable composition. The present composition can also be arrived at with the use of 100% scrap, depending on the type of scrap which is added to the melt system. For example, a typical can plant may require 83% can body stock (3004) and 17% can end stock (CS42). Of these stocks, byproduct scrap is produced as 24.9% can scrap and 2.7% end scrap for a net 27.6% plant scrap to be melted. Plant scrap and consumer scrap in the form of returned consumer cans may be added to the melt. Assuming 5% melt loss in plant scrap and 8% melt loss in returned consumer cans, a return of all cans produced at that can plant will require an adjustment of only 7.2% prime aluminum in the melt to arrive at the composition of the present alloy. This amount can be further reduced through the use of other scrap alloys in the melt, including the use of scrap of the present alloy.

With the use of prior art alloy compositions, it has not been possible to reduce the amount of primary or unalloyed aluminum necessary to obtain a useful melt alloy composition from consumer scrap to below 40% of the charge in the melting furnace. The alloy used in the present invention permits the formulation of the present composition from at least 40% scrap over a wide range of proportions of can scrap, plant scrap and consumer scrap.

The present alloy provides a number of advantages which are derived in obtaining the alloy composition from the melt. A prime advantage is, as stated, the fact that the present alloy is readily obtainable from recycling presently existing aluminum scrap. As a further advantage, the present alloy exhibits a high tolerance for silicon, iron, copper and other elements which are regarded as undesirable impurities in conventional alloys but which are inevitably present in consumer scrap. For example, a relatively high concentration of titanium may be tolerated, which is important from a recycling standpoint because a great deal of consumer scrap contains titanium oxide which is reduced to titanium during melting and dissolved in the molten alloy. A high tolerance for titanium is also important because the titanium level will build up as scrap is remelted through successive cycles. A range from 0.15% to 0.20% may be expected and may be tolerated in the present alloy.

As a further example, the alloy may contain a relatively high level of silicon from sand or dirt in the scrap. The present alloy tolerates this level and furthermore, at silicon levels above 0.45, using the range of elements given above, provides the additional advantage of being heat treatable. Heat treatment refers to the process wherein an alloy is heated to a temperature that is high enough to put the soluble alloying elements or compounds ($Mg_2Si$) into solid solution, typically 510°-610° C. The alloy is then quenched to keep these elements in supersaturated solid solution. The alloy is then age hardened, either at room temperature or at an elevated temperature, during which time a precipitate forms to harden the alloy. The age hardening may take place at temperatures currently used to cure polymeric coatings in aluminum containers, as described below. Accordingly, when using a heat treatable alloy in manufacturing operations involving a polymer curing step, the alloy may be age hardened simultaneously with the curing. This permits the use of fabrication processes which yield sheets with less strength than would otherwise be required in the as-rolled sheet.

METAL TREATMENT

After the alloy in the melting furnace is adjusted to the desired composition, the molten alloy is treated to remove materials such as dissolved hydrogen and non-metallic inclusions which would impair the casting of the alloy and the quality of the finished sheet. A gaseous mixture comprising chlorine and an inert gas such as nitrogen or argon is passed through at least one carbon tube disposed in the bottom of the furnace to permit the gas to bubble through the molten alloy. The gaseous mixture is bubbled through the molten alloy for approximately 20–40 minutes and produces dross which floats to the top of the molten alloy and is skimmed off by an suitable method. The lower magnesium concentration of the present alloy results in less dross and magnesium burn-off than 5082, 5182 and other conventional end alloys. The skimmed alloys is then filtered through a bed of an inert, particulate, refactory medium, such as aluminum oxide, to further remove non-metallic inclusions. In the filter, a gaseous mixture, as described above, is again bubbled through the molten alloy countercurrent to the alloy flow for further degassing.

CONVENTIONAL CASTING

The molten alloy is then cast by the direct chill process to produce an ingot. The direct chill casting process is well known and need not be described in detail. Basically, the molten metal is poured within a predetermined temperature range, 700°-750° C., for the present alloy, into a mold. The mold has fixed side walls and a movable bottom in the case of a vertical mold, or fixed walls and a movable side plug in the case of a horizontal mold.

The metal which has been poured into the mold solidifies, and the solid portion is slid from the mold, and through the fixed walls, as the movable portion of the mold is withdrawn. The fixed walls are internally cooled and lubricated to facilitate passage therethrough of solidified metal. Metal leaving the mold is cooled with a direct spray of water onto the metal, or ingot. For sheet ingot, molds are made in a wide variety of sizes depending on handling equipment and other factors. For optimum casting, the ingot leaving the mold is usually about twice as wide as it is thick.

An alloy having a composition according to the present invention may be cast in a given sheet-type mold at rates in excess of 110 kg per minute, compared to a maximum rate of 110 kg per minute for 3004 alloy. The present alloy may be cast more rapidly due to its finer grain size, closer dendrite spacing, and smaller primary constituent ($(FeMn)Al_6$) size. These qualities also produce less cracking during casting with a resultant reduction in plant scrap from scrapped ingots.

The cast ingots are then scalped to remove non-uniformities in the composition from the outer, rolling surfaces of the ingot. Scalping refers to a knifing treatment of the rolling surfaces of the ingot, and the knifed or shaved outer portions of the ingot are one source of plant scrap, as shown in FIG. 1. Less scalping is required for the ingots formed of the present composition than is required for ingots of 3004. Scalping in the present alloy is approximately one-half inch per side, for a 25% reduction in scalping over a typical 3004 process.

SHEET FABRICATION FROM CAST INGOTS

The scalped ingot is then preheated to 550°–600° C., preferably 570° C., for a four to six hour soak time. Soak time refers to a holding time within a given temperature range, excluding heating and cooling times. This compares favorably to a typical four to six hour preheat treatment of 565°–610° C. for 3004. A lower preheat temperature is possible because of the lower manganese and higher magnesium content of the present alloy compared to 3004.

The preheat temperature is selected to be below the non-equilibrium solidus of the alloy, that is, below the lowest temperature of incipient melting of any phase or component present. Molecular mobility at the soak temperature homogenizes the composition of the ingot after the segregation which occurs in casting, redistributes the alloying elements, and reduces grain boundary concentrations. In addition, certain solid state reactions occur in manganese, silicon and iron containing alloys in which some of the phase $(FeMn)Al_6$ is transformed to the form alpha Al(FeSiMn). The present alloy exhibits a greater alpha transformation at a given temperature than 3004, which results in less tool galling during the draw-and-iron can body manufacturing described below. The present alloy is fabricated to achieve a minimum 25% alpha transformation, typically 30–50% or more. Alpha transformation may be brought about during the preheat treatment, or during the below described steps of hot rolling, carried out at a high temperature to a high reduction, or during a high temperature annealing step.

After preheating, the ingot is cooled to an initial hot rolling temperature of 450°–510° C. and subjected to an initial hot rolling step termed a hot breakdown. The ingot does not require a slow cool, but may be air cooled in still air at ambient temperature. The initial hot rolling temperature, while not critical, is significantly lower than that used for 5182 (480°–525° C.). In hot breakdown, the ingot is reduced to a thin slab, typically 19 mm thick, from a 47.6 cm (19 in.) scalped ingot, for a 96% reduction. Hot breakdown reduction should be between 40% and 96% and serves to form the alloy into a shape suitable for further hot rolling. Hot breakdown is suitably accomplished in multiple passes through a reversing mill, as is known in the art.

After hot breakdown, the slab is immediately continuously hot rolled on a multistand hot mill to a reduction of 70–96%, preferably about 85%, for a reduction from 19 mm to 3.0 mm. Lubricants, as are known in the art, are used during hot rolling to prevent transfer of metal from the slab to the work rolls and to cool the mill rolls. The strip thus formed is at a cold rolling gauge which is selected to give the finish gauge after appropriate cold rolling. The present alloy is considerably softer than 5182 and requires less energy for reduction in both hot and cold working, and is less subject to edge cracking. The hot rolled strip is then coiled at a finish temperature, which is preferably 300° C., but may be lower depending on the capability of the particular hot mill employed.

The coiled strip is then annealed as required for further cold rolling. Annealing should be carried out at 315°–400° C., preferably at about 345° C., for a 2–4 hour soak time. In hot mills which are capable of providing a finish temperature sufficient to avoid cold working (i.e. about 315° C.), annealing may be omitted. Annealing is defined as a heat treatment above the recrystallization temperature of the alloy and designed to remove the preferred orientation of the grains of the alloy that result from hot working below the recrystallization temperature.

Annealing may also be carried out by flash annealing the strip in a continuous strip annealer wherein the strip is heated to 350°–500° C. for 3 to 90 seconds, preferably 3 to 30 seconds. Flash annealing provides better earing and improved elongation characteristics in sheet fabricated for use as can body stock. From the standpoint of necessary mill equipment, flash annealing is compatible with the solution heat treatment, described above, wherein the alloy is heated to 525°–550° C. and then rapidly quenched.

After hot rolling and any necessary annealing, the strip is work hardened to final gauge.

Figure 2:
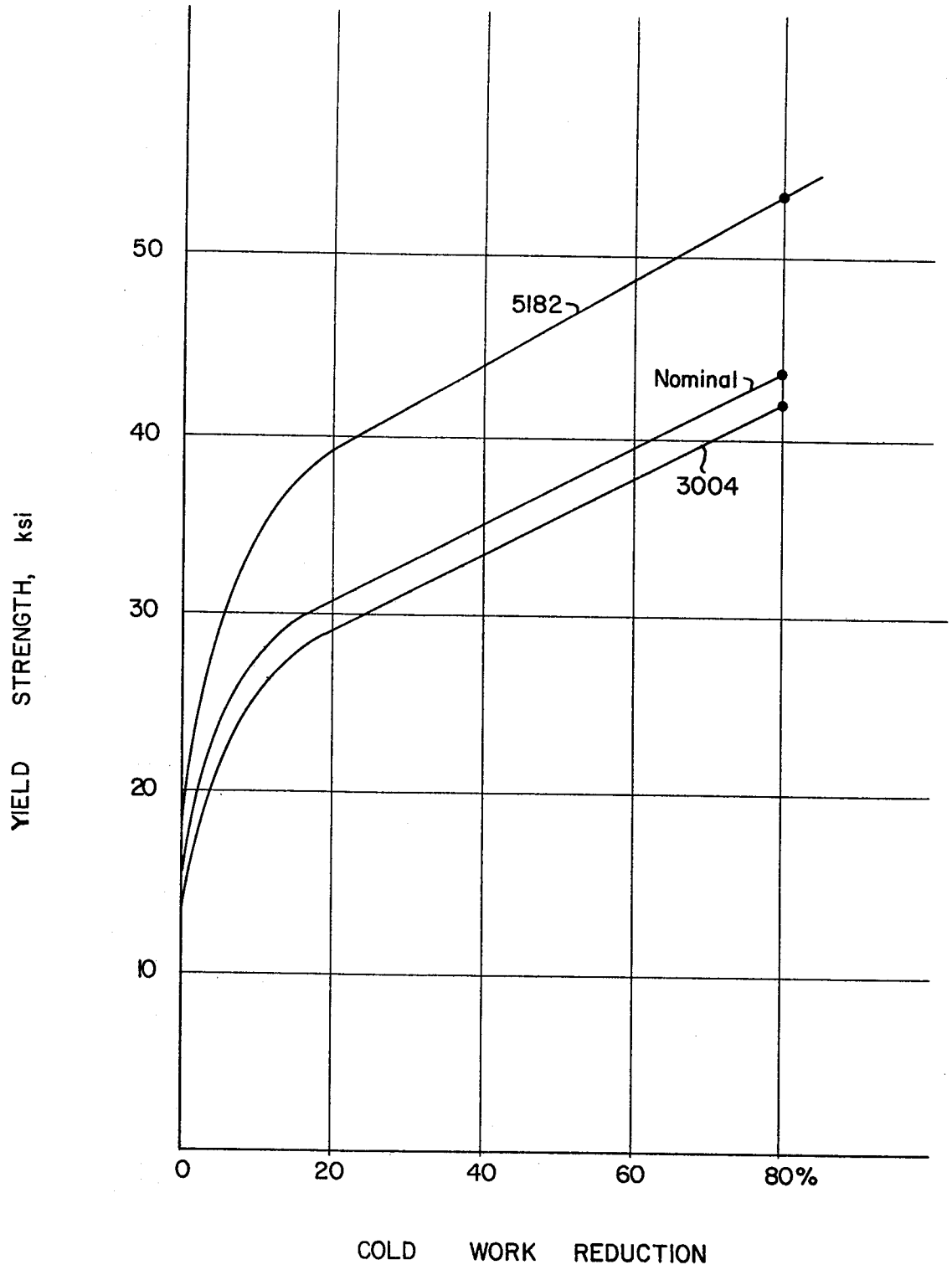
FIG. 2 is a graph showing the work hardening rate of the alloy used in the present invention.

Work hardening refers to the increase in strength of an alloy as a function of the amount of cold work reduction imposed on the metal. Compared to conventional can end stock, the alloy of the present invention work hardens at a slower rate, as shown in FIG. 2. This means that fewer passes are necessary to achieve final gauge or that the same number of passes may be taken at a higher speed or greater width. Better flatness and less edge cracking also result from the present alloy than from conventional end stock. Moreover, the work hardening rate of the present alloy compares favorably with that of 3004 conventional body stock, which demonstrates that an excessive amount of cold working is not required to obtain sufficient alloy strength for can body stock.

The following cold rolling schedule is designed to produce can stock suitable for drawing-and-ironing into can bodies:

After annealing, the coiled strip is allowed to cool to below 200° C., typically to room temperature, and reduced from 3.0 mm to 0.34 mm, or 89%, preferably ine one pass on one or more multiple stand tandem mills.

Alternatively, the strip may be cold rolled through multiple passes on a single stand mill according to the following schedule: 3.0 mm to 1.30 mm to 0.66 mm to 0.34 mm. Annealing between cold rolling reductions is termed interannealing, and, if necessary, is carried out as described above. Interannealing may be necessary if cracking occurs is intermediate passes or to modify the final cold rolled properties of the strip. In the preferred single stand practice, an interanneal is carried out before the final pass. If interannealing is carried out, the final pass should preferably be between 40–60%. Interannealing in this practice is beneficial in reducing earing during drawing-and-ironing. A combination of single stand and multiple stand mills may also be used to perform the required cold working according to the work hardening rate shown in FIG. 2.

The sheet is then finished by shearing or slitting to the desired width. The sheet thus fabricated has a yield strength of 37–45 ksi (253–310 MPa), preferably 39–42 ksi (269–289 MPa); an ultimate tensile strength of 38–46 ksi, (262–317 MPa), preferably 40–44 ksi (276–303 MPa), and a percent elongation (ASTM) of 1–8%, preferably 2–3%.

The following cold rollingschedule is designed to produce end stock having sufficient flexibility and strength for forming can ends:

Sheet of 3.0 mm from hot rolling is cold rolled in one pass on a multiple stand tanden mill to 0.26 mm for a 91% reduction. Reduction should be from 60–95%. Reduction may alternatively be carried out in 4 passes on a single stand mill as follows: 3.0 mm to 1.30 mm to 0.66 mm to 0.34 mm to 0.26 mm. Interannealing is not necessary. The sheet is then finished by shearing or slitting to the desired width. The end stock cold rolling schedules yield the following mechanical properties (as rolled): yield strength 45–54 ksi (310–370 MPa), 47–51 ksi (320–360 MPa) preferred; 47–55 ksi (320–380 MPa) ultimate tensile strength, 49–52 ksi (340–350 MPa) preferred; and elongation (ASTM) 1–5%, 1–3% preferred.

The fabrication steps described above for can body stock and can end stock are intended and designed to produce adequately strain hardened sheet based on the consideration that can body stock should have a minimum yield strength of 35 ksi (240 MPa) while end stock should have a minimum yield strength of 43 ksi (300 MPa) (as rolled).

CAN BODY MANUFACTURING

The can stock fabricated by the procedures described above is formed into one piece, deep-drawn can bodies. The sheet is first cut into circular blanks which are drawn into shallow cups by stretching the metal over a punch and through a die. The lip of the cup thus formed preferably lies in a circular plane. The extent to which the lip of the cup is not planar is referred to in the art as "earing." The alloy of the present invention exhibits up to 50% less earing at 45° to the rolling direction than 3004 can body stock in a 32–40% initial draw. As shown in Table V above, earing values of 2% or less can easily be obtained with the present alloy. Percent draw is calculated by subtracting the diameter of the cup from the diameter of the blank and dividing by the diameter of the blank. The shallow drawn cups are then redrawn and ironed in a draw-and-iron process, wherein the cup is forced through a series of dies with circular bores of diminishing diameters. The dies produce an ironing effect which lengthens the sidewalls of the can and permits the manufacture of can bodies having sidewalls thinner than their bottoms. If the metal being formed is too soft, it will tend to build up on the working surface of the ironing dies, a process referred to as "galling" and which interferes with the drawing-and-ironing operation and results in metal failure and process interruption. The present alloy exhibits less galling and tool wear than conventional can body alloys.

CAN END MANUFACTURING

In the manufacture of can ends, the end stock is levelled, cleaned, conversion coated, and primed, if desired. It is then coated as described below. The coated stock is fed to a press to form a shell, which is a shallow drawn flanged disc. The shell is then fed into a conversion press for forming an easy opening end where the end is scored and an integral rivet is formed. A tab can be made separately in a tab press and fed separately into the conversion press to be riveted on the end, or the tab can be made in the conversion press from a separate strip and the tabs and ends may be formed and joined in the conversion press. While tabs are frequently made from other alloys than used in the can ends, the alloy of the present invention has sufficient formability for use in tab manufacture. A further description of manufacturing can bodies, ends and tabs is found in Setzer et al., U.S. Pat. No. 3,787,248, and in Herrmann, U.S. Pat. No. 3,888,199 which descriptions are incorporated herein by reference.

COATING

Figure 3:
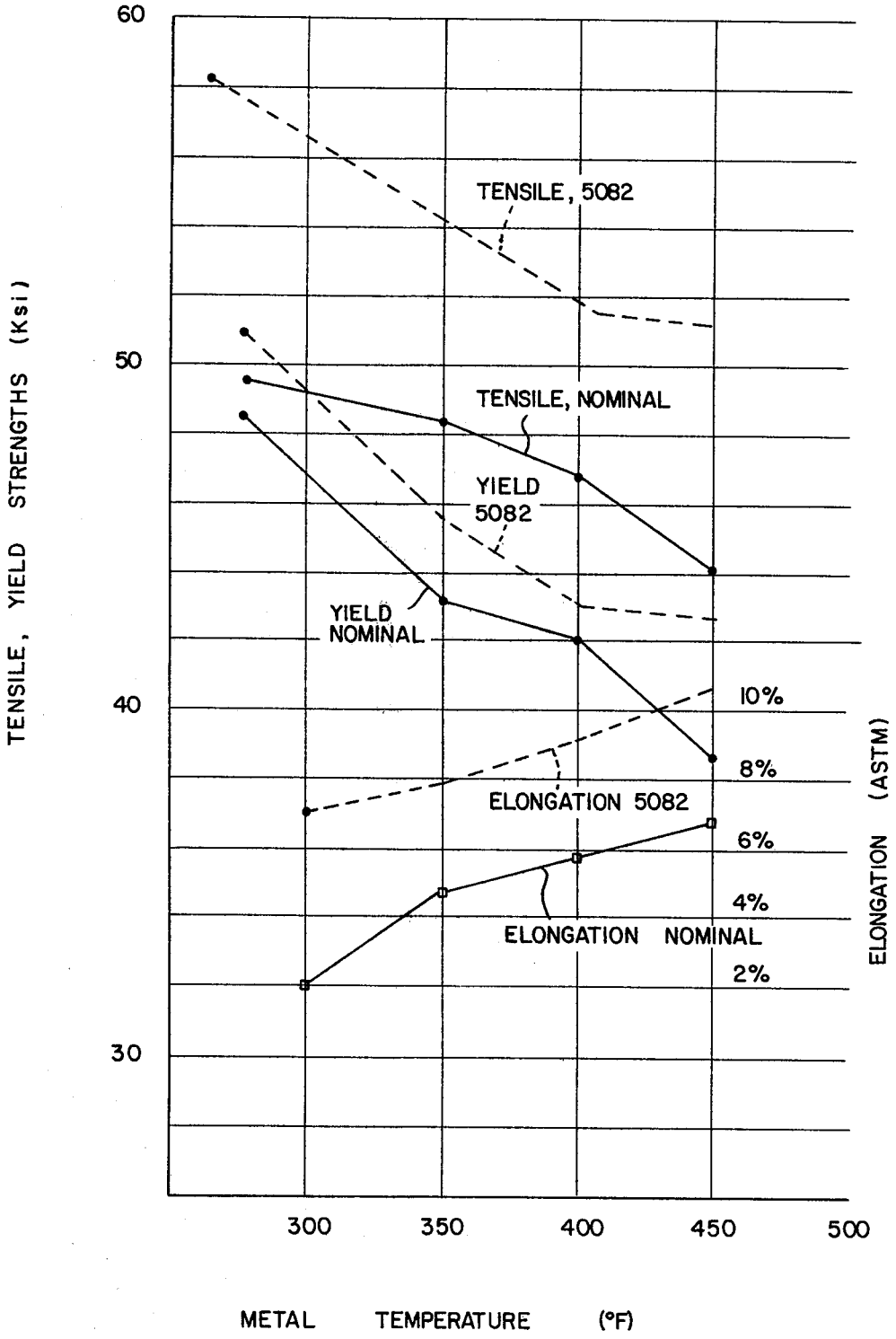
FIG. 3 is a graph showing the thermal response of the alloy used in the present invention.

Both end stock and drawn-and-ironed can bodies are commonly coated with a polymeric layer to prevent direct contact between the alloy container and the material contained therein. The coating is typically an epoxy or vinyl polymer which is applied to the metal in a powder emulsion, or solvent solution form and subsequently heat cured to form a cross-linked protective layer. The coating is typically cured at an elevated temperature of 175°–220° C. for 5 to 20 seconds. This heat treatment tends to weaken most aluminum alloys. Referring now to FIG. 3, the thermal responses of the present alloy and 5082 are shown for 85% cold work reduction at a 4 minute soak time. The curves are similar for all soak times tested. The tensile strength of the present alloy at 190° C. falls from 49 ksi (340 MPa) to 47.5 ksi (330 MPa), while the tensile strength of 5082 coated end stock falls from 58.5 ksi to 54 ksi (400–370 MPa). The thermal response for yield strengths shows a drop of 51–44 ksi for 5082 and 48–42 ksi (33–29 MPa) for the present alloy.

These figures show that the heating used to bake and cure the coatings typically applied to aluminum containers will weaken conventional end stock to a greater degree than the present alloy. Thus, the present alloy may be fabricated to a lesser "as rolled", or pre-coating, strength than other alloys and still retain sufficient strength in the final product. The elongation curves demonstrate that the present alloy increases in elongation during a given bake to a greater extent than does 5082. Thus, after a given bake, the present alloy improves in formability to a greater extent than other alloys.

While the present invention has been particularly described with regard to illustrative and presently preferred embodiments thereof, modifications of the embodiments described herein may variously be carried out. Thus it is intended that the appended claims be construed to include alternative embodiments of the inventive concepts disclosed herein, except insofar as limited by the prior art.

What is claimed is:

1. A process of fabricating aluminum sheet for aluminum containers comprising:

(a) providing an aluminum alloy consisting esentially of magnesium 0.4–1.0%; magnesium 1.3–2.5%, said manganese and magnesium being present in a total concentration of 2.0–3.3% and in a ratio of magnesium to manganese of between 1.4:1 and 4.4:1; silicon 0.15–1.0%; iron 0.1–0.9%; and copper 0.05–0.4%;

(b) casting said alloy at 700°–750° C. into an ingot;

(c) preheating said ingot to 550°–600° C.;

(d) hot rolling, between 450° C. and 510° C., said ingot to a slab;

(e) immediately continuously hot rolling said slab to a strip of cold rolling gauge; and (f) cold rolling said strip of cold rolling gauge to at least 40% reduction to form cold rolled sheet which then has properties required for manufacturing the cold rolled sheet into a container component.

2. The process of claim 1 further comprising annealing said strip before said cold rolling.

3. The process of claim 1 comprising the step of annealing between cold rolling reductions and further comprising a cold rolling reduction after annealing of 40–60% and an overall cold rolling reduction of at least 89%.

4. The process of claim 1 further comprising:

cold rolling a first portion of said strip to form can body stock; and cold rolling a second portion of said strip to form can end stock.

5. The process of claim 4 further comprising:

drawing-and-ironing said first portion of said strip to form a can body; and forming said second portion of said strip into an easy-opening end.

6. The process of claim 4 further comprising the step of annealing between cold rolling reductions only the first portion of said strip.

7. The products of the process of claim 4.

8. The process of claim 1 wherein said preheating takes place between 550°–600° C. for 4 to 6 hours.

9. The process of claim 1 wherein said hot rolling comprises a hot breakdown reduction to a slab and further comprising continuously hot rolling said slab for 70–96% reduction to said cold rolling gauge.

10. The process of claim 2 wherein said annealing is carried out at 315°–400° C. for 2 to 4 hours.

11. The process of claim 1 wherein said cold rolling is to a 60–95% reduction.

12. The process of claim 1 further characterized by a minimum 25% alpha transformation.

13. The process of claim 1 further comprising the step of annealing said strip between cold rolling reductions at 350°–500° C. for 3 to 90 seconds.

14. The process of claim 1 further comprising the step of:

solution heat treating said cold rolled strip at 510°–610° C. to put soluble alloying elements into solid solution.

* * * * *